US008242357B2

(12) United States Patent
Motoi et al.

(10) Patent No.: US 8,242,357 B2
(45) Date of Patent: Aug. 14, 2012

(54) METHOD OF PRODUCING SUBMARINE SOLID CABLE AND SUBMARINE SOLID CABLE

(75) Inventors: Kenji Motoi, Osaka (JP); Masayuki Hirose, Osaka (JP); Ryosuke Hata, Osaka (JP)

(73) Assignee: Sumitomo Electric Industries, Ltd., Osaka-shi, Osaka (JP)

( * ) Notice: Subject to any disclaimer, the term of this patent is extended or adjusted under 35 U.S.C. 154(b) by 280 days.

(21) Appl. No.: 12/675,427

(22) PCT Filed: Aug. 4, 2008

(86) PCT No.: PCT/JP2008/063942

§ 371 (c)(1), (2), (4) Date: Feb. 26, 2010

(87) PCT Pub. No.: WO2009/028303

PCT Pub. Date: Mar. 5, 2009

(65) Prior Publication Data

US 2010/0206616 A1 Aug. 19, 2010

(30) Foreign Application Priority Data

Aug. 27, 2007 (JP) ..... 2007-220194
Jun. 11, 2008 (JP) ..... 2008-153590

(51) Int. Cl.
*H01B 13/06* (2006.01)

(52) U.S. Cl. ..... 174/25 R

(58) Field of Classification Search ..... 174/25 R
See application file for complete search history.

(56) References Cited

U.S. PATENT DOCUMENTS 6,399,878 B2 * 6/2002 Kondo et al. ..... 174/25 R

FOREIGN PATENT DOCUMENTS

| | | |
|---|---|---|
| JP | 11-224546 | 8/1999 |
| JP | 2000-268652 | 9/2000 |
| JP | 2002-245867 | 8/2002 |

* cited by examiner

*Primary Examiner* — Chau Nguyen
(74) *Attorney, Agent, or Firm* — Drinker Biddle & Reath LLP

(57) ABSTRACT

The invention offers a submarine solid cable that can suppress the movement of the insulating oil when the cable is used and the production method thereof. The method of producing a submarine solid cable forms an insulating layer by lapping insulating tapes, each of which includes a resin film, over the outer circumference of a conductor and impregnates the insulating layer with medium-viscosity insulating oil. The insulating layer is formed by lapping insulating tapes, each of which includes a resin film, over the outer circumference of the conductor 1. The insulating layer is impregnated with an insulating oil having an at least medium viscosity. The resin film is swelled to narrow an impregnation path impregnated with the insulating oil. According to the production method, the impregnation path for the insulating oil is secured when the impregnation with the insulating oil is performed and the impregnation path is narrowed to suppress the movement of insulating oil when the cable is used. Thus, the cable can have excellent insulation properties.

10 Claims, 5 Drawing Sheets

METHOD OF PRODUCING SUBMARINE SOLID CABLE AND SUBMARINE SOLID CABLE

TECHNICAL FIELD

The present invention relates to a method of producing a submarine solid cable suitable for transmitting a large electric power over a long distance and to the submarine solid cable.

BACKGROUND ART

A solid cable, which has been used as a submarine cable for transmitting electric power, is produced through the following process, for example. First, the outer circumference of the conductor is covered with an inner semiconducting layer. Insulating tapes (insulating-paper tapes) are lapped over the outer circumference of the inner semiconducting layer to form an insulating layer. An outer semiconducting layer is formed at the outside of the insulating layer to form a cable core. The cable core is taken up in a tank to undergo vacuum drying for removing the water in the insulating layer. Next, highly viscous insulating oil is introduced into the tank to pressure-impregnate the insulating layer with the oil. Subsequently, the insulating layer is covered with a metal sheath, which is then covered with an anticorrosion covering. Furthermore, a steel-wire armoring, a protecting layer, and so on are formed at the outside of the anticorrosion covering. An example of the structure of the foregoing solid cable is shown in FIG. 5 (the steel-wire armoring and protecting layer are omitted). This cable has, from the center in this order, a conductor 1, an inner semiconducting layer 2, an oil-impregnated insulating layer (hereinafter referred to as an insulating layer) 3, an outer semiconducting layer 4, a metal sheath (made of lead or the like) 5, and an anticorrosion covering (made of polyethylene or the like) 6.

A solid cable, which has the above-described structure, has been used in which the insulating layer 3 is formed by using kraft-paper tapes, which are free from swelling by the insulating oil, and is impregnated with relatively highly viscous insulating oil (high-viscosity oil). However, the viscosity of the insulating oil decreases as the temperature rises. As a result, the maximum operating temperature of the solid cable has been limited to 55° C. or so. In this type of cable, under a condition that a load is applied (the ON condition) and the conductor is at the maximum operating temperature, when the load is interrupted (the OFF condition), the high-viscosity oil, which has expanded and moved to the outside of the insulating layer, cannot follow the temperature decrease sufficiently. As a result, the pressure at the inner-side portion of the insulating layer (the portion in the vicinity of the conductor), in particular, becomes negative, forming voids at that portion. Usually, the cable is designed such that the void formation does not affect the insulating performance. Consequently, the operating temperature is limited to 55° C. or below. When the maximum operating temperature is increased to a temperature higher than 55° C. in order to increase the transmission capacity, electrical discharge at the voids formed at the time of the load interruption (the OFF condition) can cause insulation breakdown. As a result, it has been difficult to meet the requirement of increasing the operating temperature and transmission capacity in order to realize long-distance large-power transmission.

To solve the above-described problem, a solid cable and a production method thereof have been proposed (see Patent Literature 1, for example). This cable not only uses, as the insulating oil with which the insulating layer 3 is impregnated, medium-viscosity insulating oil (medium-viscosity oil) having a viscosity of 10 cst or more and less than 500 cst at 60° C. but also uses insulating tapes, each of which includes a polyolefin-family resin film, in at least one portion of the insulating layer 3. Because the foregoing solid cable uses medium-viscosity oil having a viscosity lower than that of the high-viscosity oil, the variation in the oil volume resulting from the temperature variation can be suppressed. Consequently, the insulating oil having moved to the outer-radius side of the insulating layer at the time the load is applied is likely to return to the inner-radius side at the time the load is interrupted. Thus, the formation of the voids that can lead to the insulation breakdown is suppressed. Therefore, it can be expected that the cable satisfies the requirement of increasing the operating temperature and transmission capacity by exploiting the above-described features.

Patent Literature 1: the published Japanese patent application Tokukaihei 11-224546

SUMMARY OF INVENTION

Technical Problem

Despite the above description, when a solid cable is used, for example, as a submarine cable, the cable is installed at a route having differences in height. When the route has differences in height, the gravity exercises its effect. More specifically, the insulating oil, particularly medium-viscosity oil, moves toward the lower portion, sometimes creating a condition devoid of the insulating oil (oil drainage) at a higher portion.

Generally, a copper-woven fabric tape (not shown) is wound between the outer semiconducting layer 4 and the metal sheath 5 to use the copper wires to secure the electrical continuity between the outer semiconducting layer 4 and the metal sheath 5. The layer formed by winding the copper-woven fabric tape has gaps more than those in the insulating layer 3. Consequently, when the insulating oil having moved to the outside of the insulating layer 3 cannot return to the insulating layer 3, the insulating oil remains in the above-described gaps. In this case, when the cable installation route has differences in height, the insulating oil remaining in the gaps moves downward along the layer formed by winding the copper-woven fabric tape. As a result, the higher portion is likely to become devoid of the insulating oil. Furthermore, the foregoing condition devoid of the insulating oil may promote the axial growth of the voids formed at the time of the load variation or the like. In particular, a submarine cable is difficult to repair. Accordingly, the realization of a measure to suppress the creation of the condition devoid of the insulating oil has been required.

On the other hand, a solid cable impregnated with high-viscosity oil is less likely to create the oil drainage in comparison with a solid cable using medium-viscosity oil. Nevertheless, the high-viscosity-oil-impregnated cable has a problem in that not only does the insulation performance decrease resulting from the formation of voids at the time of the load interruption as described above but also a prolonged time is required in the step of impregnation with the insulating oil in comparison with a solid cable impregnated with medium-viscosity oil.

The present invention is made in view of the above-described circumstances. An object of the present invention is to offer a method of producing a submarine solid cable that can secure high insulation performance when the cable is used and to offer the submarine solid cable.

Another object of the present invention is to offer a method of producing a submarine solid cable that is impregnated with medium-viscosity oil and that can suppress the oil drainage when the cable is used and to offer the submarine solid cable.

Yet another object of the present invention is to offer a method of producing a submarine solid cable that is impregnated with high-viscosity oil, that can shorten the time of impregnation with the insulating oil when the cable is produced, and that can secure high insulation performance when the cable is used; and to offer the submarine solid cable.

Solution to Problem

It has been known that as the impregnation temperature is increased when the insulating layer is impregnated with insulating oil, the impregnation can be performed with a shortened time. However, when the insulating tape is formed of a composite tape of a resin film and a kraft-paper tape, depending on the impregnation temperature, the resin film is swelled. Usually, the insulating layer is impregnated with insulating oil from its outer-radius side. Consequently, when the resin film at the outer-radius-side portion of the insulating layer is swelled at the earlier stage of the impregnation step, the resin film compresses the kraft-paper tape, which functions as the impregnation path for the oil. This compression leads to the narrowing or closing of the impregnation path. As a result, the inner-radius-side portion of the insulating layer cannot be sufficiently impregnated with the insulating oil. Even when the impregnation is performed sufficiently, it takes extremely long time. Therefore, the swelling of the resin film at the time of the impregnation has been considered to be an undesirable phenomenon in the production process of the solid cable.

The present inventors have changed the thinking from the conventional understanding and have studied the positive utilization of the swelling property of the resin film both for the suppression of the movement of the insulating oil when the cable is used and for the improvement of insulation properties of the cable. Thus, the present invention has been completed. The swelling property of the resin film is defined as the relationship between the temperature of the insulating oil and the thickness-increasing rate of the resin film obtained by using the thickness before and after the impregnation of the insulating layer with oil at that temperature. The thickness-increasing rate of the resin film is defined by the following formula:

{(the thickness of the insulating tape after the swelling due to the impregnation with oil−the thickness of the insulating tape before the impregnation with oil)/the thickness of the insulating tape before the impregnation with oil}×100.

The method of the present invention for producing a submarine solid cable is a method of producing a submarine solid cable having an insulating layer impregnated with an insulating oil. The method has the following steps:

(a) forming the insulating layer by lapping insulating tapes, each of which includes a resin film, over the outer circumference of a conductor, (b) impregnating the insulating layer with the insulating oil having a viscosity of at least medium viscosity, and (c) narrowing an impregnation path impregnated with the insulating oil by swelling the resin film.

As described earlier, in the conventional solid cable, the insulating layer is formed by using kraft-paper tapes, which are free from swelling by the insulating oil, and is impregnated with a high-viscosity oil. In this type of cable, the high-viscosity oil cannot sufficiently follow the rapid temperature drop in the vicinity of the conductor. At this portion, voids are likely to form. Consequently, the maximum operating temperature has been limited to 55° C. or so. However, in the case of an insulating layer formed by using, in place of kraft-paper tapes, insulating tapes each of which includes, for example, a polyolefin-family resin film, when the insulating layer is impregnated with an insulating oil having a medium or high viscosity, the resin film is swelled. Therefore, the utilization of the above-described swelling property enables the production of a submarine solid cable that has good insulation properties when the cable is used.

More specifically, by providing the step of narrowing the impregnation path utilizing the swelling of the resin film after the step of the impregnation with the insulating oil, the insulating oil can be suppressed from moving when the cable is used. In other words, the swelling of the resin film can enhance insulation properties of the insulating tape itself. In the case of the medium-viscosity insulating oil, because of the suppression of the movement of the insulating oil to the outside of the insulating layer when a load is applied, the volume of the insulating oil existing between the metal sheath and the insulating layer is decreased. This decrease can suppress the oil drainage. In the case of the high-viscosity insulating oil, because of the suppression of the movement of the insulating oil to the outside of the insulating layer when a load is applied, voids are suppressed from forming and therefore insulation properties are improved. Consequently, the above-described submarine solid cable can be suitably applied to a land-side portion, which not only has a difference in height but also is likely to be affected by the temperature variation in the outside air because this portion is partially exposed on the land.

In the foregoing method of producing a submarine solid cable, the following operations may be implemented:

(a) in the step of impregnating the insulating layer with the insulating oil, the resin film is swelled at a low degree, and (b) in the step of narrowing the impregnation path, the resin film is swelled at a high degree.

When the above-described operations are implemented, in the step of impregnating the insulating layer with the insulating oil, by swelling the resin film at a low degree, the impregnation path for the insulating oil can be secured, so that even when the high-viscosity oil is used, the impregnation of the insulating layer can be performed in a short time. In addition, in the step of narrowing the impregnation path, by swelling the resin film at a high degree, the impregnation path can be narrowed, so that the insulating oil can be suppressed from moving when the cable is used.

The low swelling of the resin film in the step of impregnation and the high swelling of the resin film in the step of narrowing the impregnation path can be realized, for example, by heating the insulating layer at a temperature higher than an impregnation temperature of the insulating oil in the step of impregnation. In other words, as the step of narrowing the impregnation path, it is required only to heat the insulating layer at a temperature higher than the impregnation temperature of the insulating oil.

According to the above description, by heating the oil-impregnated insulating layer at a temperature higher than the impregnation temperature, the resin film can be effectively swelled, so that the impregnation path can be easily narrowed.

It is desirable that a forming condition of the insulating layer be selected by considering a swelling property expressed by a thickness-increasing rate of the resin film after the step of impregnating the insulating layer with the insulating oil.

The swelling property of the resin film in the insulating tape can be obtained in advance. Usually, when the same resin film and insulating oil are used, as the impregnation temperature is increased, the amount of swelling of the resin film is increased. Consequently, for example, at an impregnation temperature of 90° C. to 100° C., the amount of swelling of the resin film is relatively small (low swelling), and at an impregnation temperature of 110° C. to 120° C., the amount of swelling of the resin film is relatively large (high swelling). Generally, the amount of swelling of the resin film by high-viscosity oil is larger than that by medium-viscosity oil. For example, at the same temperature, whereas the thickness-increasing rate by medium-viscosity oil is 2%, the thickness-increasing rate by high-viscosity oil is about 3%. As described above, the swelling property of the resin film can be obtained in advance. Therefore, when the forming condition of the insulating layer is selected in accordance with the swelling property, this procedure enables easy formation of an insulating layer that facilitates the impregnation with insulating oil or of an oil-impregnated insulating layer in which the insulating oil is less likely to move when the cable is used.

One of the forming conditions for the insulating layer is to adjust lapping tensions of the insulating tapes in the step of forming the insulating layer to form the impregnation path for the insulating oil in the insulating layer.

When the lapping tension of the insulating tape is increased, the surface-to-surface pressure between layers of the insulating tapes is increased, so that the impregnation path can be narrowed and therefore oil drainage can be less likely to occur when the cable is used. Nevertheless, in the cable production process; tearing, buckling, or the like in the insulating tapes becomes likely to develop. In contrast, when the tension is decreased, not only becomes oil drainage likely to occur but also irregularities in the gap and wrinkling both of the insulating tapes become likely to occur. Consequently, in the tension range that enables proper lapping of the insulating tapes, when the tension is set at a rather low value, the impregnation path for the insulating oil can be easily formed in the insulating layer. As a result, in the subsequent impregnation step, the impregnation with the insulating oil can be efficiently performed. This effect is particularly noticeable in the case of the high-viscosity oil. In the method of the present invention, because the impregnation path is narrowed in the subsequent step, even when a relatively wide impregnation path is employed at the time of the impregnation with the insulating oil, no excessive movement of the insulating oil occurs when the cable is used.

It is desirable that in the step of forming the insulating layer, lapping tensions of the insulating tapes be adjusted in accordance with an impregnation temperature of the insulating oil.

When the impregnation temperature of the insulating oil is low, the viscosity of the insulating oil is high. Consequently, when lapping tensions of the insulating tapes are set at rather low values to form a somewhat wide impregnation path in the insulating layer, the impregnation with the insulating oil can be performed easily. Inversely, when the impregnation temperature of the insulating oil is high, the viscosity of the insulating oil is low. Consequently, even when lapping tensions of the insulating tapes are set at rather high values, it is possible to secure the impregnation path in the insulating layer. As a result, the impregnation with the insulating oil is not excessively prolonged.

It is desirable that in the step of forming the insulating layer, the impregnation path for the insulating oil be formed by lapping the insulating tapes under a lapping condition less rigid than that for lapping kraft-paper tapes over the conductor.

As described earlier, by adjusting lapping tensions of the insulating tapes, the wideness of the impregnation path in the insulating layer can be adjusted. The reference for determining the magnitude of the lapping tension can be the lapping condition of the kraft-paper tapes for producing a solid cable having an oil-impregnated insulating layer composed only of kraft-paper tapes. When the insulating tape is composed only of kraft paper, because the kraft paper is not swelled by the insulating oil, it can be said to be appropriate to use the lapping condition for lapping kraft-paper tapes over the conductor as the reference. For example, when the lapping tension of the insulating tape including a resin film is decreased from the lapping tension of the kraft-paper tape, the impregnation path can become wider. In this case, also, when the impregnation path in the insulating layer can be formed wide, the impregnation with the insulating oil can be performed easily.

In addition, the impregnation path for the insulating oil can be formed in the insulating layer by adjusting a water content of the insulating tapes prior to the step of impregnating the insulating layer with an insulating oil.

For example, after the formation of the insulating layer, when the water is removed from the insulating tape, the thickness of the insulating tape is decreased. As a result, the impregnation path for the insulating oil can be easily formed in the insulating layer. In this case, also, when the impregnation path is sufficiently secured in the insulating layer, the impregnation with the insulating oil can be performed easily.

It is desirable that the insulating tape be formed by unifying a polyolefin-family resin film and a kraft-paper tape.

The above-described insulating tape can utilize the kraft-paper tape as the principal impregnation path for the insulating oil. When the insulating tape is impregnated with the insulating oil, the resin film is swelled at a certain temperature. The amount of swelling is determined by the type of insulating oil, the thickness proportion of the resin film in the insulating tape, and the impregnation temperature. Consequently, after the impregnation of the insulating layer with the insulating oil, by properly swelling the resin film with the insulating oil, the kraft-paper tape to be used as the impregnation path can be compressed to narrow the impregnation path for the insulating oil. Of course, the swelling of the resin film enables a further tightening of the insulating tapes. Therefore, the lapping tension of the insulating tape may be decreased by the amount corresponding to the amount of increasing tightening.

The above-described insulating oil may be a medium-viscosity oil.

When a medium-viscosity oil is used as the insulating oil, in comparison with the high-viscosity oil, the insulating layer is more easily impregnated when the cable is produced and the insulating layer forms fewer voids at the time of load interruption when the cable is used. Furthermore, because the swelling of the resin film narrows the impregnation path, even the medium-viscosity oil can suppress the oil drainage effectively.

As another insulating oil, a high-viscosity oil may also be used.

When a high-viscosity oil is used as the insulating oil, in comparison with the solid cable using the medium-viscosity oil, the oil drainage is less likely to occur when the cable is used. In addition, when the cable is produced, because the impregnation with the insulating oil can be performed under the condition that the impregnation path is secured in the insulating layer, the impregnating operation can be conducted with high efficiency. Furthermore, the high-viscosity oil is more likely to swell the resin film in comparison with the medium-viscosity oil. Because the swelling narrows the impregnation path, the movement of the insulating oil is suppressed more effectively.

A submarine solid cable of the present invention has the following components:

(a) a conductor, (b) an insulating layer formed by lapping insulating tapes in multiple layers over the outer circumference of the conductor, and (c) an insulating oil with which the insulating layer is impregnated.

In this cable:

(d) the insulating tapes are each formed by unifying a resin film and a kraft-paper tape, (e) the insulating oil has a viscosity of at least medium viscosity, and (f) the resin film is swelled by the insulating oil in order to achieve intimate contact between layers of the insulating tapes when the cable is used.

When the cable has the above-described features, when the cable is used, the resin film is swelled by the insulating oil, so that not only are insulation properties of the insulating tape itself improved but also practically no gap is formed between layers of the insulating tapes. As a result, the radial and axial movement of the insulating oil in the cable is suppressed. Consequently, even when the foregoing submarine solid cable is installed, for example, at an inclined portion in the vicinity of the shore, the cable can secure high insulation performance when the cable is used. In addition, the inclined portion in the vicinity of the shore is relatively short in the entire line of the submarine cable. Therefore, even when a solid cable using a high-viscosity oil, which requires a prolonged time for the impregnation step, is employed for the inclined portion, the entire installation period of the submarine solid cable is not affected noticeably.

It is desirable that this submarine solid cable have the following features:

(a) the insulating oil is a medium-viscosity oil, and (b) in order to suppress the axial movement of the insulating oil in the cable when the cable is used, the kraft-paper tape is compressed in the thickness direction due to the swelling of the resin film.

When the cable has the above-described features, because the swelling of the resin film compresses the kraft-paper tape in the thickness direction, the impregnation path for the oil is narrowed. Consequently, this swelling can suppress the occurrence of the oil drainage caused by the movement of the medium-viscosity oil.

In addition, it is desirable that a submarine solid cable of the present invention have the following features:

(a) the insulating oil is a high-viscosity oil, and (b) in order to suppress voids from forming in the insulating layer when the cable is used, the kraft-paper tape is compressed in the thickness direction due to the swelling of the resin film.

When the cable has the above-described features, because the swelling of the resin film compresses the kraft-paper tape in the thickness direction, the gap between the insulating tapes is crushed. As a result, the formation of voids in the insulating layer is suppressed and consequently the insulation performance is improved.

Advantageous Effect of Invention

A method of the present invention for producing a submarine solid cable provides, after the step of the impregnation with the insulating oil, a step of narrowing the impregnation path impregnated with the insulating oil. As a result, the radial and axial movement of the insulating oil can be suppressed when the cable is used. Consequently, in the case of the medium-viscosity insulating oil, the oil drainage can be suppressed. In addition, in the case of the high-viscosity insulating oil, the formation of voids is suppressed and consequently the insulation performance is improved.

A submarine solid cable of the present invention has a feature in which the resin film is swelled by the insulating oil to prevent practical formation of gaps between layers of the insulating tapes when the cable is used. As a result, the radial and axial movement of the insulating oil can be suppressed when the cable is used. Consequently, in the case of the medium-viscosity insulating oil, the oil drainage can be suppressed. In addition, in the case of the high-viscosity insulating oil, the formation of voids is suppressed and consequently the insulation performance is improved.

REFERENCE SIGN LIST

Figure 1:
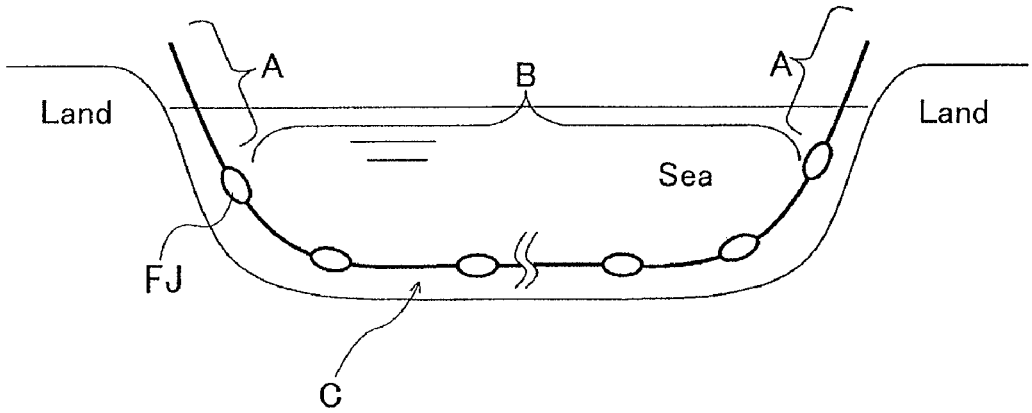
FIG. 1 is an illustration for an installation condition of a submarine solid cable in an embodiment of the present invention.

1: Conductor
2: Inner semiconducting layer
3: Insulating layer
3*a*: Resin film (polypropylene (PP) film)
3*b*: Kraft-paper tape
4: Outer semiconducting layer
5: Metal sheath
6; Anticorrosion covering
12: Pipe
13: Insulating layer
14: Oil-reserving portion
A: Land-side portion
B: Sea-bottom-side portion
C: Submarine solid cable
FJ: Joint

DESCRIPTION OF THE PREFERRED EMBODIMENTS

Figure 2:
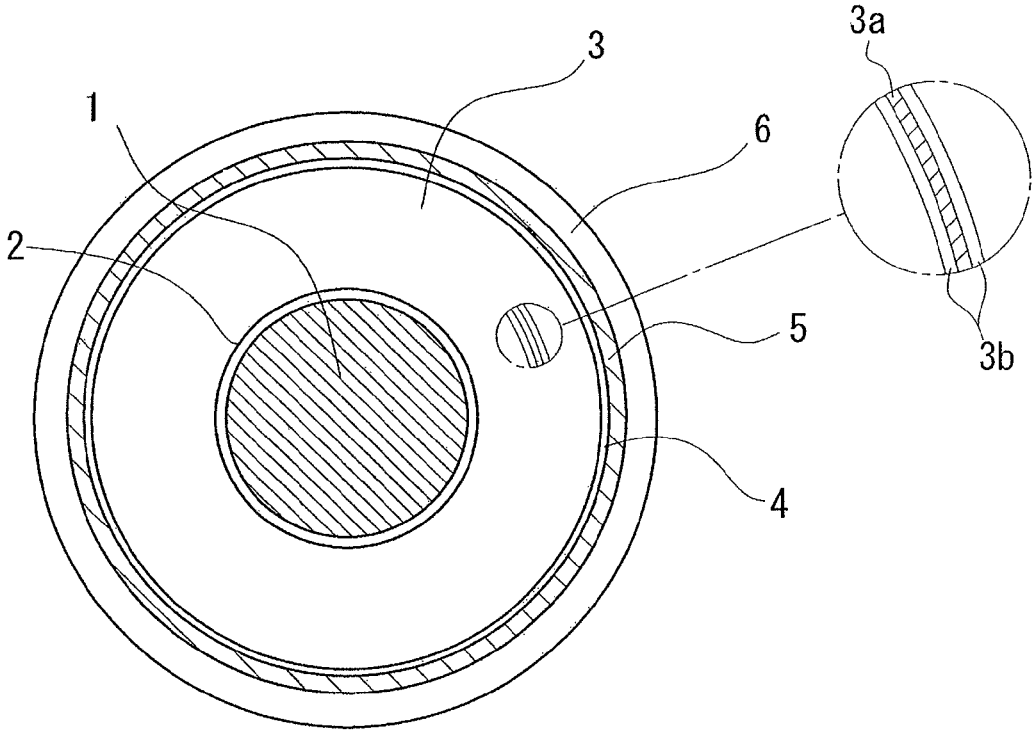
FIG. 2 is a cross-sectional view of a submarine solid cable in an embodiment of the present invention.

An explanation is given below to a submarine solid cable and the production method thereof both in embodiments of the present invention. In the explanation of the drawing, the same sign is given to the same element to eliminate duplicated explanations. The ratio of the dimensions in the drawing does not necessarily coincide with that in the explanation. FIG. 1 is an illustration for a condition under which a submarine solid cable C is installed. As shown in FIG. 1, the submarine solid cable C has a structure in which a sea-bottom-side portion B, which is installed on the bottom of the sea, and a land-side portion A, at least one part of which is installed on the land, are jointed together through a joint FJ. The solid cable constituting the submarine solid cable C has a structure as shown in FIG. 2, for example. More specifically, the cable is composed of, from the center in this order, a conductor 1, an inner semiconducting layer 2, an oil-impregnated insulating layer (hereinafter referred to as an insulating layer) 3, an outer semiconducting layer 4, a metal sheath 5, an anticorrosion covering 6, and so on.

In the above structure, the insulating layer is formed by lapping insulating tapes, each of which includes a resin film, over the conductor. The insulating tape is suitably formed by using a composite tape in which a kraft-paper tape is laminated with one side or both sides of a polyolefin-family resin film. The insulating layer may be formed by alternately lapping a composite tape, in which a kraft-paper tape is laminated with both sides of a polyolefin-family resin film, and an insulating tape composed only of a polyolefin-family resin film. The insulating layer may also be formed by alternately lapping a composite tape, in which a kraft-paper tape is laminated with one side of a polyolefin-family resin film, and a kraft-paper tape. The types of the composite tape include PPLP (registered trade mark, Polypropylene Laminated Paper), which has the shape of a tape formed by unifying a kraft-paper tape 3*b* with both sides (or one side) of a polypropylene (PP) film 3*a*, which is a resin film (see a partly enlarged view in FIG. 2).

As the insulating oil with which the insulating layer is impregnated, medium-viscosity oil or high-viscosity oil can be used. The medium-viscosity oil is an insulating oil having a viscosity of 10 cst or more and less than 500 cst at 60° C. A typical example of the medium-viscosity oil is polybutene. In addition, the types of medium-viscosity insulating oil include polystyrene-based insulating oil, mineral oil, synthetic oil composed mainly of alkylbenzene, heavy alkylate, and a mixture of these including more than one type.

The high-viscosity oil is an insulating oil having a viscosity of 500 cst or more, particularly 1,000 cst or more, at 60° C. A typical example of the high-viscosity oil is naphthene-based oil. More specifically, the types of the oil include T2015 (trade name; made by Dussek Campbell, Ltd.). T2015 has a viscosity of 1,200 cst at 60° C. and a specific gravity of 0.93 (5° C.). It has been used as the insulating oil for a DC submarine solid cable.

The submarine solid cable C having the above-described structure is produced through the following process, for example. First, the outer circumference of the conductor 1 is covered with the inner semiconducting layer 2. Insulating tapes are lapped over the outer circumference of the inner semiconducting layer 2 to form the insulating layer 3. Then, the outer semiconducting layer 4 is formed to form the cable core. As described below, when the insulating layer 3 is formed, the condition for forming the insulating layer 3 is selected considering the amount of swelling of the resin film by the insulating oil. The cable core is taken up in a tank (not shown) to undergo vacuum drying for removing the water in the insulating layer 3. Next, insulating oil is introduced into the tank to perform pressure impregnation of the insulating layer 3. Generally, as the impregnation temperature is increased, the viscosity of the insulating oil is decreased. Consequently, the impregnating operation becomes easy, so that the impregnating time is shortened. In addition, the amount of swelling of the resin film increases, increasing the surface-to-surface pressure between layers of the insulating tapes. As a result, the oil drainage can become less likely to occur. However, when the impregnation temperature is excessively high, the amount of swelling of the resin film is excessively increased and consequently the kraft-paper portion is excessively compressed. This causes a partial blockage in the impregnation path, prolonging the time for the impregnation with oil. In contrast, when the impregnation temperature of the oil is low, the viscosity does not decrease, rendering the impregnation with oil difficult. Furthermore, virtually no swelling of the resin film in the insulating layer occurs, so that oil drainage is likely to occur. Therefore, the impregnation temperature can be selected as appropriate by taking the above-described matters into consideration. After the pressure impregnation, the resin film in the insulating tape is swelled to narrow the impregnation path. Subsequently, the insulating-oil-impregnated cable core is covered with the metal sheath 5, which is then covered with the anticorrosion covering 6. In particular, it is desirable that a solid cable having a narrowed impregnation path be installed as the cable for the land-side portion A, which is to be installed at an inclined portion in the vicinity of the shore, in view of the suppression of the oil drainage and the improvement in insulation properties.

Use of Medium-Viscosity Oil for Impregnation

An explanation is given to the case where the land-side portion A is impregnated with medium-viscosity oil. The land-side portion A is installed at a location having a difference in height and is directly affected by the temperature variation in the outside air. In other words, the land-side portion A is installed under an environmental condition where oil drainage is especially likely to occur axially in the cable toward a lower portion. Consequently, it is required to consider how to suppress the occurrence of the oil drainage when the cable is used. To meet this requirement, first, the swelling property (the thickness-increasing rate) of PPLP is measured in advance. Then, considering the swelling property, the forming condition of the insulating layer 3 can be properly selected so that the insulating layer 3 can have the optimal surface-to-surface pressure after the impregnation with oil. For example, the following actions can be taken:

(1) the adjusting of the tension at the time the insulating tapes are lapped (the lapping tension), and (2) the adjusting of the temperature at which the impregnation with insulating-oil is performed (the impregnation-with-oil temperature) at the time of the cable production by previously obtaining the relationship between the impregnation-with-oil temperature and the swelling property.

The swelling property is defined as the relationship between the oil temperature and the thickness-increasing rate of the resin film obtained by using the thickness before and after the impregnation of the insulating layer with oil at that temperature. The thickness-increasing rate is defined by the following formula:

{(the thickness of the insulating tape after the swelling due to the impregnation with oil−the thickness of the insulating tape before the impregnation with oil)/the thickness of the insulating tape before the impregnation with oil}×100.

The lapping tension may be selected as appropriate within the range that does not cause tearing of an insulating tape at the time of lapping or irregularity in lapping in the insulating layer after the lapping. Usually, as the lapping tension is increased, the surface-to-surface pressure between layers of the insulating tapes in the insulating layer 3 is increased, and as the lapping tension is decreased, the surface-to-surface pressure is decreased. However, the surface-to-surface pressure is also affected by the swelling property of PPLP. Therefore, it is desirable that a proper lapping tension be selected considering the previously obtained swelling property, as described above. At a usual impregnation temperature, the amount of swelling of PPLP by polybutene-based oil is small. Consequently, practically no impediment of the impregnation with oil is exercised by the swelling of PPLP. Nevertheless, depending on the impregnation-temperature condition, the amount of swelling of PPLP may increase, excessively increasing the surface-to-surface pressure. In this case, any of the following measures can be selected: decreasing the lapping tension, decreasing the impregnation-with-oil temperature, or adjusting both of them. Consequently, to obtain a proper surface-to-surface pressure, it is desirable that the lapping tension and the impregnation-with-oil temperature be properly adjusted considering the temperature dependence of the swelling property of PPLP.

Oil Movement Test by Heat Cycles

Figure 3A:
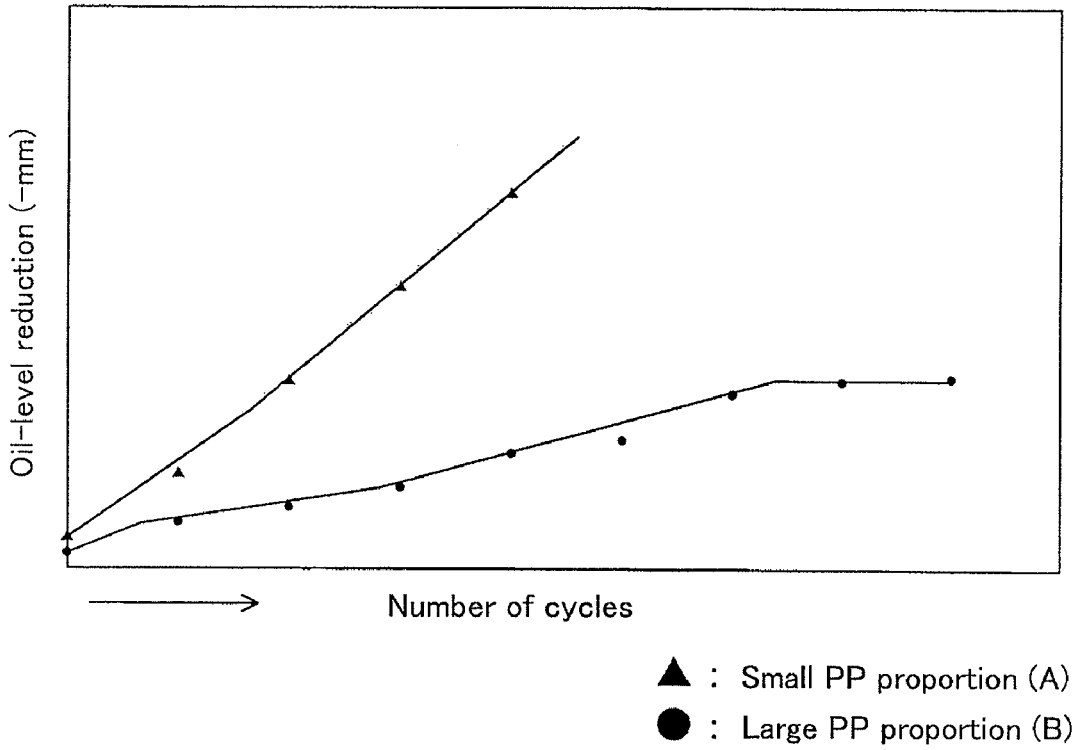
FIG. 3A is a diagram for explaining the oil-movement test by heat cycles in the case of the medium-viscosity insulating oil in an embodiment of the present invention and shows a graph showing the test results.
Figure 3B:
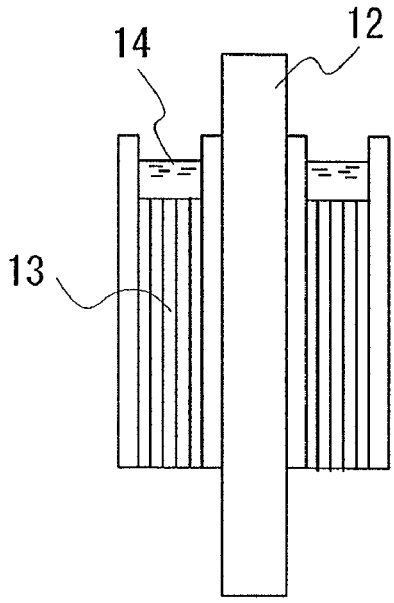
FIG. 3B is a diagram for explaining the oil-movement test by heat cycles in the case of the medium-viscosity insulating oil in an embodiment of the present invention and shows a vertical section of the test piece.

To simulate the state of the oil drainage, an oil movement test by heat cycles was conducted (see FIGS. 3A and 3B). In this test, as shown in FIG. 3B, first, a sheet-shaped material having the same laminated structure as that of the insulating tape was wound around a pipe 12 to form an insulating layer 13. Next, an oil-reserving portion 14 was provided on top of the insulating layer 13 and the bottom of the insulating layer 13 was maintained open. The test piece was subjected to predetermined heat cycles. Under this condition, the downward movement of the oil that was filled in the oil-reserving portion 14 was measured to evaluate the movement characteristic of the oil. In this test, two types of material for the insulating tape were used for the test piece. More specifically, the following two types of material were used: Material A that had a small PP proportion (in thickness) in the sheet-shaped material (PPLP) in which a kraft-paper sheet was bonded to both sides of a PP film and Material B that had a large PP proportion (in thickness) in the PPLP. The test pieces having the individual materials were impregnated with polybutene. Under this condition, the same type of polybutene was filled in the oil-reserving portion 14. Heat cycles were repeated between the ordinary temperature (20° C. to 25° C.) and an elevated temperature (80° C.) to measure the variation (reduction) in the oil level.

The measured results are shown in FIG. 3A, in which the result of Material A is shown by the mark "▲" and that of Material B, by the mark "●." The horizontal axis of FIG. 3A represents the number of heat cycles and the vertical axis, the variation in the oil level. As can be seen from FIG. 3A, in Material A, which has a small PP proportion, the variation in oil level is noticeable and in Material B, which has a large PP proportion, the variation in oil level is small. This result suggests that as the PP proportion decreases, the oil becomes more likely to move longitudinally in the cable due to heat cycles. Consequently, it is desirable to increase the PP proportion in the insulating tape as the condition for forming the insulating layer 3 that is less likely to develop the oil drainage. For example, for the use of the composite tape (PPLP) in which a kraft-paper tape is laminated with both sides of a PP film, it is desirable that the proportion of the thickness of the PP film in the entire thickness of PPLP be set at 60% to 90%, for example. After a proper material is selected in this way, the lapping tension, the impregnation-with-oil temperature, and the like can be properly selected, as discussed earlier.

For example, when the impregnation-with-oil temperature is relatively low (100° C. or below, for example), the amount of swelling of the insulating tape is small, so that the swelling has almost no influence on the value of the surface-to-surface pressure between insulating tapes. Consequently, the proper selection of the lapping tension for the insulating tapes enables the easiest and most reliable securing of an optimal surface-to-surface pressure. In other words, for the selection of the lapping tension, it is desirable to lap the insulating tapes with the allowable maximum tension within the range that does not cause any technical problem in the step of lapping the insulating tapes and in the step of taking-up. In the above description, the expression "the range that does not cause any technical problem" is used to mean the range that does not cause any problem in the cable production process, such as the development of buckling, tearing, wrinkling, or the like in the insulating tapes or rendering the cable excessively stiff to such an extent that the bending operation becomes too difficult to take up the cable. The foregoing range can be obtained empirically in accordance with the size (diameter and length) of the cable, the types of insulating oil to be used, and the like. In particular, it is desirable to determine the PP proportion and the lapping tension by referring to the above-described result of the oil-movement test by heat cycles.

The impregnation-with-oil temperature is to be selected within the range that does not cause the reduction (deterioration) of the performance of the insulating layer 3. When the insulating layer 3 includes a polyolefin-family resin film, the maximum allowable temperature is determined considering the film's melting point in oil. Polyethylene has a melting point in oil of 110° C. or so, and polypropylene, 130° C. to 140° C. In the case where a medium-viscosity oil such as polybutene is used as the insulating oil, when the temperature is increased, the viscosity decreases, facilitating the impregnation of the insulating layer 3. Consequently, the impregnation can be completed with a short time. However, the decreasing of the temperature requires a prolonged time. Therefore, it is desirable to perform the impregnation at the lowest possible temperature in the range that facilitates the impregnation. When the impregnation-with-oil temperature (and the impregnation time) is selected so as to obtain a proper surface-to-surface pressure by considering the relationship between the impregnation-with-oil temperature and the swelling property (the thickness-increasing rate) of the insulating tape, a submarine solid cable can be obtained that is free from oil drainage when the cable is used. When an insulating tape including a PP film is impregnated with polybutene, the impregnation temperature can be set at 120° C. or below, for example. For the selection of such a desirable impregnation temperature, the above-described oil movement test by heat cycles can be used as a reference.

After the insulating tapes are impregnated with insulating oil, the insulating tapes may be heated further at a temperature higher than the impregnation-with-oil temperature in order to swell the insulating tape. When this procedure is employed, the heating after the impregnation can swell the resin film in the insulating tape. By considering the amount of swelling at that time, the impregnation-with-oil temperature can be set as low as appropriate. This method facilitates the impregnation of the insulating layer 3 with the insulating oil. In addition, by shortening the time necessary to lower the temperature of the insulating layer after the impregnation, the total time of impregnation with oil can be shortened. When an insulating tape including a polypropylene film is impregnated with polybutene, the impregnation-with-oil temperature may be set, for example, at 100° C. or below to perform additional heating at 110° C. or 120° C. after the impregnation with oil. An additional data is given below. An example of the measurement of the swelling property of PPLP having a PP proportion of 70% when polybutene (Grade HV-15) is used shows that the thickness-increasing rate from the initial value is +0.92% at 100° C. and +2.20% at 120° C.

Alternatively, by considering the amount of swelling after the impregnation with oil, the lapping tension may be set at a lower value in accordance with that amount. This method broadens the range of selection of the lapping tension, thereby enabling the selection of an appropriate tension that prevents the development of buckling, tearing, wrinkling, or the like in the insulating tapes. For example, when a high tension is applied to the insulating tape, troubles such as buckling, tearing, wrinkling, and the like are likely to develop. Consequently, it sometimes becomes difficult to apply a required tension to the insulating tape. In such a case, the following procedure can be employed. First, the insulating tapes are lapped with an appropriate tension in the range that does not cause a trouble. The impregnation with oil is performed at a desirable temperature. Finally, as described above, an additional heating is conducted. Thus, a needed surface-to-surface pressure can be secured. According to the above procedure, the total time of impregnation with oil can be shortened.

Furthermore, the lapping tension may be adjusted in accordance with the impregnation-with-oil temperature at the time the insulating layer 3 is impregnated with insulating oil. Because the amount of swelling of the insulating tape varies in accordance with the impregnation-with-oil temperature, by adjusting the lapping tension considering the swelling property, a more appropriate surface-to-surface pressure can be secured.

As described above, when the medium-viscosity oil is used, the impregnation of the insulating layer can be performed relatively easily in comparison with the case where the high-viscosity oil is used. Consequently, even when the insulating layer is formed with a comparatively high lapping tension in order to achieve intimate contact between insulating tapes, the impregnation path for the insulating oil can be secured. Nevertheless, depending on the impregnation condition for the insulating oil, even the medium-viscosity oil sometimes encounters difficult impregnation. In this case, as described below in the section "use of high-viscosity oil for impregnation," it is desirable to form a somewhat wide impregnation path in advance by adjusting the forming condition of the insulating layer.

Use of High-Viscosity Oil for Impregnation

The land-side portion A not only has a difference in height along the cable but also is directly affected by the temperature variation in the outside air. When the cable in this portion is impregnated with high-viscosity oil, stable and high insulation performance is required. More specifically, a consideration must be given to the prevention of the formation of voids between layers of the insulating tapes in the insulating layer 3 when the cable is used. To meet this requirement, it is desirable that the swelling property (the thickness-increasing rate) of PPLP be measured in advance and that by considering the swelling property, the forming condition of the insulating layer 3 be selected. The swelling property of PPLP is defined by the same manner as in the case of the medium-viscosity oil.

An explanation is given below to the case where the insulating layer 3 is impregnated with a high-viscosity oil such as T2015 (trade name; made by Dussek Campbell, Ltd.). To form, at the time of impregnation, an impregnation path for oil in the insulating layer 3, the insulating layer 3 is impregnated with high-viscosity oil at an impregnation temperature that can suppress the swelling of the PP film in the insulating tapes forming the insulating layer to a low degree. After the impregnation, it is desirable to heat the insulating layer 3 at a temperature higher than the foregoing impregnation temperature to swell the PP film to a high degree so that the impregnation path can be narrowed. More specifically, when the impregnation temperature at the time of the impregnation with high-viscosity oil is set, for example, at 100° C. or so, the swelling of the insulating tape can be suppressed to a low degree (low swelling). Consequently, the kraft-paper tape, which forms the principal impregnation path, can remain without being compressed by the PP film. As a result, an impregnation path that allows even high-viscosity oil to perform easy impregnation can be secured, so that the impregnation with high-viscosity oil becomes easy. After the impregnation with high-viscosity oil, when the insulating layer 3 is heated, for example, at 120° C. or so, the PP film in the insulating tape swells at high degree, achieving the narrowing of the impregnation path. This condition suppresses the radial movement of the insulating oil in the insulating layer when the cable is used, so that almost no voids are formed. Even when the temperature of the metal sheath reaches 80° C. or so, virtually no movement of the high-viscosity oil occurs, thereby stabilizing and improving insulation properties. More specifically, the insulating tapes are brought into intimate contact with one another in the thickness direction, the PP film included in the insulating tape is swelled by the high-viscosity oil, and the kraft-paper tape is impregnated with the insulating oil. As a result, there exists no gap filled with practically only insulating oil between layers of the insulating tapes. This condition can secure high insulation properties.

Figure 4:
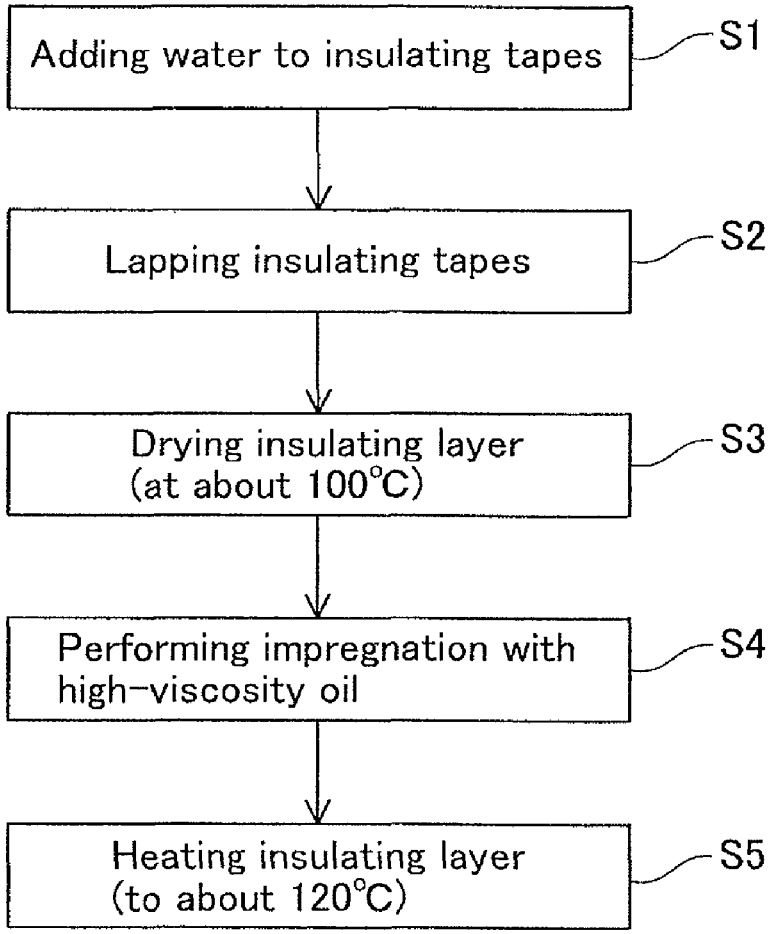
FIG. 4 is an example of a flow chart showing the procedure of the steps for impregnating the insulating layer with high-viscosity insulating oil in an embodiment of the present invention.
Figure 5:
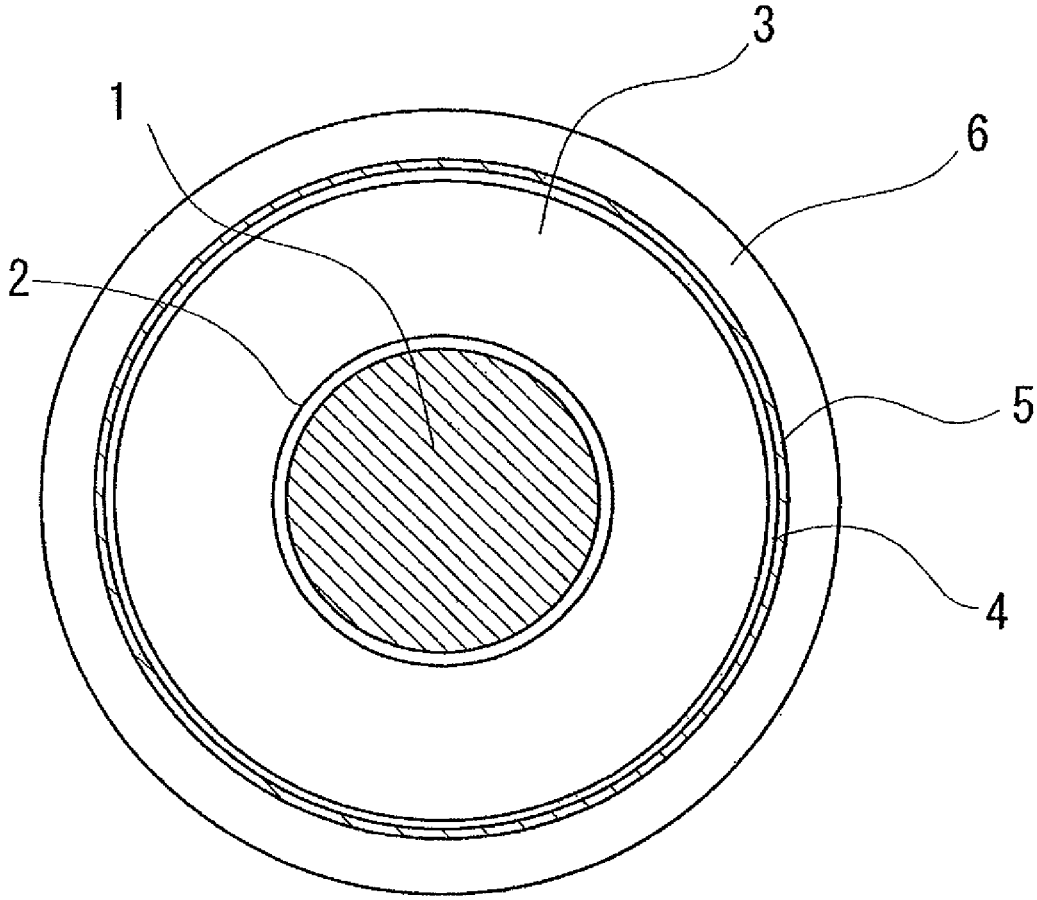
FIG. 5 PRIOR ART
FIG. 5 is a cross section of a conventional solid cable.

Alternatively, a high-viscosity oil such as T2015 (trade name; made by Dussek Campbell, Ltd.) may be used for the impregnation in a process as shown, for example, in a flow chart in FIG. 4. In this case, to form in the insulating layer 3 an impregnation path for the oil at the time the impregnation with the insulating oil is performed, the water content in the insulating tapes forming the insulating layer 3 is adjusted. More specifically, for example, about 10 wt. % water is added to the insulating tapes in advance (S1). The water is absorbed by the kraft-paper tapes in the insulating tapes. Under this condition, the insulating tapes are lapped over the outer circumference of the inner semiconducting layer 2 (S2). Subsequently, in the step of vacuum drying of the cable core, the water is evaporated, for example, at 100° C. to reduce the water content to several weight percent or so (S3). This operation can form a gap, which is to be used as the impregnation path for the oil, between insulating tapes. The thickness of the gap corresponds to the amount of reduction in the thickness of the kraft-paper tape in the insulating tape. Under the condition that the foregoing impregnation path is formed in the insulating layer 3, the impregnation with the high-viscosity oil can be performed (S4). After the completion of the impregnation, the insulating layer 3 is heated, for example, to 120° C. or so (S5). As the temperature rises, the PP film in the insulating tape swells further, narrowing the impregnation path. This process prevents the formation of voids (cavities) when the cable is used, thereby stabilizing and improving insulation properties. In other words, this process can satisfy the following two mutually contradicting requirements: one is to secure a sufficiently wide impregnation path when the impregnation with the insulating oil is performed, and the other is to narrow the impregnation path to suppress the movement of the insulating oil when the cable is used. When this cable is used and then the temperature of the metal sheath reaches 80° C. or so, almost no movement of the high-viscosity oil occurs. This feature is the same as that of the previous example. The drying process for adjusting the water content as described above can be implemented by utilizing the drying step in the production process for the ordinary solid cable. Therefore, no additional improvement of or addition to the equipment is required and the setting of the forming condition for the insulating layer 3 is easy.

The present invention is not limited to the foregoing embodiments and may be improved or changed without restraint as appropriate when required providing that the improvement, changing, or the like does not deviate from the gist of the present invention. Accordingly, the combination of constitutions and methods employed in the individual embodiments may be carried out without restraint. For example, in the forming step of the insulating layer, both of the adjustment of the lapping tension of the insulating tape and the adjustment of the water content of the insulating tape may be performed. In addition, by adjusting the stranding condition of the conductor 1, gaps for performing the impregnation with the insulating oil, especially high-viscosity oil, can be formed in the insulating layer. More specifically, after the insulating tapes are lapped over the conductor 1 in which the elementary wires are loosely stranded, a tension is applied to the conductor 1 to tighten the stranded wires. This operation reduces the diameter of the conductor 1, thereby enabling the formation of gaps between the insulating tapes. Alternatively, after the insulating tapes are lapped over the conductor 1 that is expanded by heating, the temperature of the conductor 1 is lowered. This operation reduces the diameter of the conductor 1, thereby enabling the formation of gaps between the insulating tapes for performing the impregnation with the insulating oil.

It is to be considered that the above-disclosed embodiments and examples are illustrative and not restrictive in all respects. The scope of the present invention is shown by the scope of the appended claims, not by the above-described explanations. Accordingly, the present invention is intended to cover all revisions and modifications included within the meaning and scope equivalent to the scope of the claims.

INDUSTRIAL APPLICABILITY

The method of the present invention for producing a submarine solid cable can offer a submarine solid cable that can secure stable and high insulation performance when the cable is used. Consequently, the method is suitable for the field of production, for example, for the land-side portion of a submarine solid cable to be installed at the shore portion.

Accordingly, a submarine solid cable of the present invention can secure stable and high insulation performance when it is used. Consequently, the cable can be suitably applied, for example, to the land-side portion of a submarine solid cable to be installed at the shore portion.

The invention claimed is:

1. A method of producing a submarine solid cable having an insulating layer impregnated with an insulating oil, the method comprising the steps of:

(a) forming the insulating layer by lapping insulating tapes, each of which includes a resin film, over the outer circumference of a conductor;

(b) impregnating the insulating layer with the insulating oil having a viscosity of at least medium viscosity; and (c) narrowing an impregnation path impregnated with the insulating oil by swelling the resin film, wherein in the step of narrowing the impregnation path, the insulating layer is heated at a temperature higher than an impregnation temperature of the insulating oil to swell the resin film.

2. The method of producing a submarine solid cable as defined by claim 1, wherein:

(a) in the step of impregnating the insulating layer with the insulating oil, the resin film is swelled at a low degree; and (b) in the step of narrowing the impregnation path, the resin film is swelled at a high degree.

3. The method of producing a submarine solid cable as defined by claim 1, wherein a forming condition of the insulating layer is selected by considering a swelling property expressed by a thickness-increasing rate of the resin film after the step of impregnating the insulating layer with the insulating oil.

4. The method of producing a submarine solid cable as defined by claim 1, wherein the insulating tapes are each formed by unifying a polyolefin-family resin film and a kraft-paper tape.

5. The method of producing a submarine solid cable as defined by claim 1, wherein the insulating oil is a medium-viscosity oil.

6. The method of producing a submarine solid cable as defined by claim 1, wherein the insulating oil is a high-viscosity oil.

7. A method of producing a submarine solid cable having an insulating layer impregnated with an insulating oil, the method comprising the steps of:

(a) forming the insulating layer by lapping insulating tapes, each of which includes a resin film, over the outer circumference of a conductor;

(b) impregnating the insulating layer with the insulating oil having a viscosity of at least medium viscosity; and (c) narrowing an impregnation path impregnated with the insulating oil by swelling the resin film, wherein in the step of forming the insulating layer, lapping tensions of the insulating tapes are adjusted to form the impregnation path for the insulating oil in the insulating layer.

8. The method of producing a submarine solid cable as defined by claim 7, wherein in the step of forming the insulating layer, lapping tensions of the insulating tapes are adjusted in accordance with an impregnation temperature of the insulating oil.

9. A method of producing a submarine solid cable having an insulating layer impregnated with an insulating oil, the method comprising the steps of:

(a) forming the insulating layer by lapping insulating tapes, each of which includes a resin film, over the outer circumference of a conductor;

(b) impregnating the insulating layer with the insulating oil having a viscosity of at least medium viscosity; and (c) narrowing an impregnation path impregnated with the insulating oil by swelling the resin film, wherein in the step of forming the insulating layer, the impregnation path for the insulating oil is formed by lapping the insulating tapes under a lapping condition less rigid than that for lapping kraft-paper tapes over the conductor.

10. A method of producing a submarine solid cable having an insulating layer impregnated with an insulating oil, the method comprising the steps of:

(a) forming the insulating layer by lapping insulating tapes, each of which includes a resin film, over the outer circumference of a conductor;

(b) impregnating the insulating layer with the insulating oil having a viscosity of at least medium viscosity; and (c) narrowing an impregnation path impregnated with the insulating oil by swelling the resin film, wherein the impregnation path for the insulating oil is formed in the insulating layer by adjusting a water content of the insulating tapes prior to the step of impregnating the insulating layer with an insulating oil.

* * * * *